United States Patent [19]

Misevich

[11] 3,980,023

[45] Sept. 14, 1976

[54] PAYLOAD CARRYING TUBULAR PROJECTILE

[75] Inventor: Kenneth W. Misevich, Fairfield, Conn.

[73] Assignee: Remington Arms Company, Inc., Bridgeport, Conn.

[22] Filed: Sept. 11, 1974

[21] Appl. No.: 504,971

[52] U.S. Cl. ..... 102/92.6; 102/92.7

[51] Int. Cl.[2] ..... F42B 11/18; F42B 11/32

[58] Field of Search ..... 102/92, 92.1, 92.2, 102/92.3, 92.4, 92.6, 92.7, 93, 41

[56] References Cited

UNITED STATES PATENTS

| | | | |
|---|---|---|---|
| 3,528,662 | 9/1970 | Merchant et al. | 102/92.7 |
| 3,782,286 | 1/1974 | Jones | 102/92.7 |
| 3,877,383 | 4/1975 | Flatau | 102/92.1 |

OTHER PUBLICATIONS

D. N. Olson, "A Kinetically Non-Hazardous Ring Airfoil Projectile for Delivering Riot Control Agent," Aug. 1972, pp. 15–17.

*Primary Examiner*—Charles T. Jordan

*Attorney, Agent, or Firm*—Lewis, Jr. John H.; Nicholas Skovran; William L. Ericson

[57] ABSTRACT

A tubular, nonhazardous projectile having a ring airfoil shape has a plurality of recessed pockets circumferentially disposed around the body, each adjacent pair of pockets being separated by a longitudinal rib. Payload material is held in discrete compartments of a payload package, one compartment being held in each pocket of the projectile. The assembly is held together by wrapping the projectile. The projectile is propelled from a suitable launching device and, upon direct or glancing impact with a target, the wrapping breaks and the payload material is dispersed in the area of impact.

9 Claims, 8 Drawing Figures

PAYLOAD CARRYING TUBULAR PROJECTILE

This invention relates to projectiles and, more particularly, to a nonlethal, ring shaped projectile for use in the control of civil disturbances and capable of delivering a payload, such as a chemical irritant, upon impact.

Substantial research work has been conducted or funded by the U.S. Government in an attempt to develop a projectile which is capable of being fired from a firearm toward a mob during a civil disturbance, would aid in dispersal and control of the mob, and yet would have no lethal potentiality, even at close range. This research work has resulted in the development of a molded rubber annular projectile having a ring airfoil shape. When fired from a suitable launcher to impart a spin to the projectile, it travels at a fairly low velocity, about 200 feet per second, with a substantially flat trajectory. Upon impact, the projectile is felt as a sharp blow. However, even at close distance, serious physical injury is not generally produced by the projectile.

A serious drawback of the basic projectile, however, is that it is effective only against the target struck thereby. It would be preferable to disperse some effective irritant material to enhance the effectiveness of the projectile. Previous attempts to accomplish this have been generally unsatisfactory in failing to provide sufficient uniformity of dispersal of the payload material or in lacking the highly desirable aerodynamic characteristics of the solid projectile.

In accordance with this invention, a molded ring airfoil projectile is provided with a plurality of recessed pockets circumferentially disposed around the projectile. Each pair of adjacent pockets is separated by a structural rib running longitudinally along the projectile. To facilitate ease of loading, the payload material is held in a package having a plurality of compartments, the payload material being sealed in substantially equal quantities in each of the compartments. The package is wrapped around the projectile and secured with adhesive to place one compartment in each of the pockets and the projectile is wrapped to hold the assembly together. Upon direct or glancing impact, the wrapping breaks and releases the payload for effective dispersal. During flight, the ribs enhance the structural strength of the projectile while the uniform distribution of the payload material within the pockets prevents any mass imbalance of the projectile. The wrapping firmly holds the projectile body in its aerodynamic configuration.

It is an object of this invention to provide a nonhazardous projectile capable of delivering payload material for dispersal at a target.

It is another object of this invention to provide a nonhazardous projectile capable of delivering payload material to a target while maintaining structural integrity for enhanced aerodynamic characteristics.

It is still another object of this invention to provide a nonhazardous projectile capable of delivering payload material to a target and maintaining the payload material in a suitably mass-distributed fashion prior to impact at the target.

It is a further object of this invention to provide a nonhazardous projectile capable of delivering payload material to a target and characterized by ease in assembly and safe handling of the payload material.

These and other objects and advantages of this invention will be readily apparent when the following Specification is read in conjunction with the appended drawings, wherein.

Figure 4:
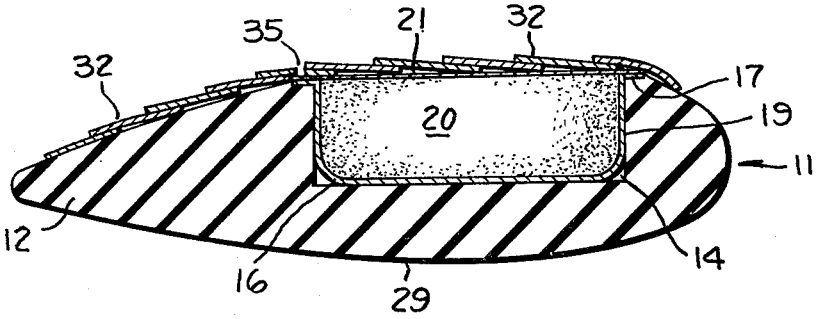
FIG. 4 is a fragmentary cross-sectional view of a projectile made in accordance with this invention.
Figure 5:
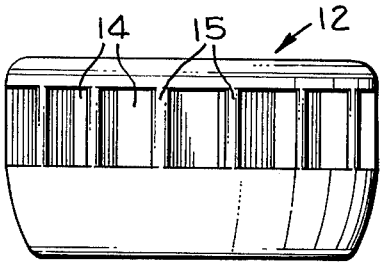
FIG. 5 is a side view of a projectile body of this invention.

Referring now to the drawings, a tubular projectile 11 in accordance with this invention preferably has a molded body 12 of elastomeric material best seen in FIG. 5. The body 12 has a ring configuration, the cross section of which is substantially in the form of an airfoil. This airfoil cross section is best seen in FIG. 4. Positioned around the body 12 are a plurality of recessed pockets 14 which are preferably rectangular and of uniform shape and size. Between each adjacent pair of pockets 14 is a rib 15 molded integrally with the body and disposed parallel to the longitudinal axis of the projectile.

The pockets 14 are provided on the body 12 to enable the projectile 11 to have payload carrying capabilities without detracting from its aerodynamic characteristics. The payload material could be placed directly in the pockets 14. However, this would be a difficult and impractical procedure, particularly because, in the preferred embodiment, the payload carried by the projectile 11 would be of the nature of a chemical irritant material which must be handled and loaded with great care. One such possible payload material is Orthochlorobenzalmolonitrile, forms of which are generally known as CS or CS-2. Accordingly, the payload material is first loaded into a suitable container such as a payload package 16 illustrated in FIG. 2.

The payload package 16 preferably comprises a base 17 which may be vacuum formed from plastic sheet to provide a plurality of spaced compartments 19 therein. The compartments 19 are filled with equal amounts of payload material 20 and sealed by a cover sheet 21. The cover sheet 21 may be of aluminum, paper or other suitable material and may be secured to the base 17 by heat sealing or a suitable adhesive material.

It will be readily apparent to those skilled in the art that the payload package 16 may be constructed through consecutive steps on a single machine. For example, after vacuum molding plastic sheet to form the base 17 with its compartments 19, payload material 20 is placed in the compartments 19 while still held in the forming molds. A cover sheet 21 of aluminum foil is then placed over the base 17 and heat sealed thereto in a well known manner. The payload package 16 may then be trimmed and removed from the molds and handled safely without substantial risk or exposure to the irritant payload material.

Figure 2:
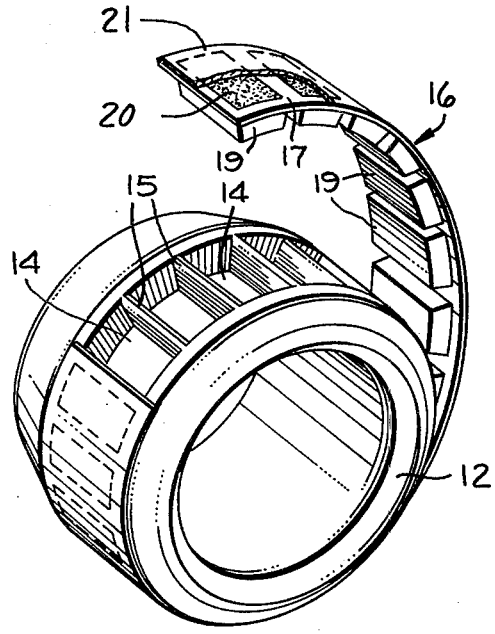
FIG. 2 is a perspective view of a partially assembled projectile showing the construction of a payload-carrying package thereof.

To secure the payload package 16 in the body 12, the pockets 14 are sprayed or rolled with an adhesive, preferably a rubber based cement, which will hold the package in place. The payload package 16 is then wrapped around the body 12 as shown in FIG. 2 with each compartment 19 being placed in a corresponding pocket 14 of the body. When the payload package 16 is positioned around the body 12, the payload material 20 is uniformly distributed around the circumference of the projectile. This uniform weight distribution is maintained by the compartmentalization of the package 16 and by the ribs 15 which prevent any circumferential shifting of the package or its material.

Figure 3:
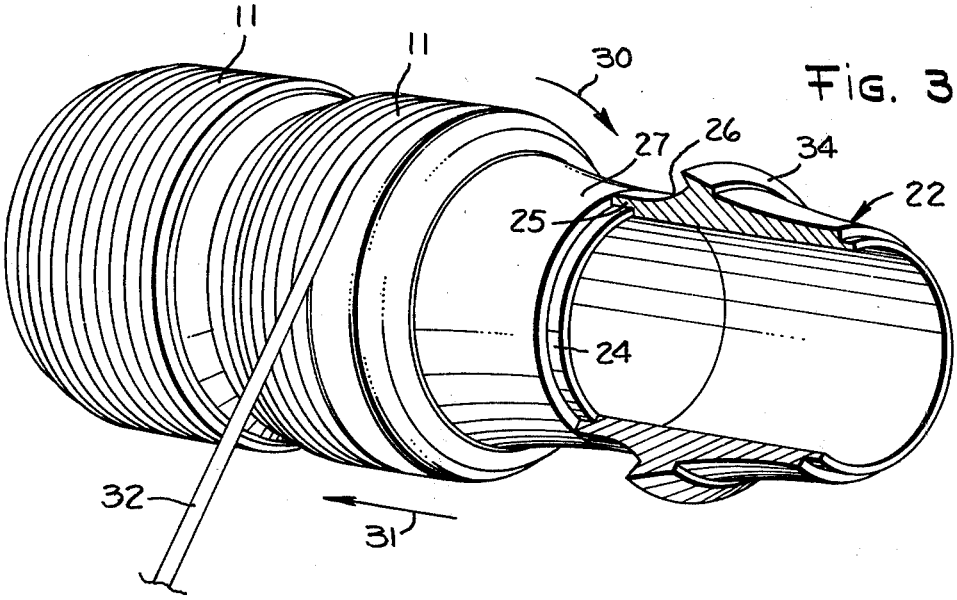
FIG. 3 is a perspective view illustrating a step in the manufacture of the payload-carrying tubular projectile of FIG. 1.

After the payload package 16 has been loaded in the body 12, the body 12 is wrapped as shown in FIG. 3. To facilitate wrapping, a plurality of mandrels 22 are used to mount the projectiles. Each mandrel has interlocking end portions 24 and 25 which permit any desired number of mandrels to be extended in line end to end. A forward portion 26 of each mandrel combines with a rear portion 27 of its adjacent mandrel to match the contour of an inner surface 29 (see FIG. 4) of the body 12. This permits each body to be readily mounted on a pair of adjacent mandrels by fitting the body onto one mandrel and placing an additional mandrel in interlocking relation thereto.

Wrapping of the projectiles may be expediently accomplished by revolving the mandrels and the projectiles mounted thereon in the direction shown by an arrow 30 in FIG. 3. At the same time, the mandrels 22 carrying the unwrapped projectiles are transported in the direction of an arrow 31 past a feeding means (not shown) for feeding a strip of wrapping material 32 onto the projectiles 11.

The strip of wrapping material 32 is preferably fairly narrow, having a width of about ⅛ in., and may, if desired, comprise two plies of material. The wrapping material should be impregnated with a suitable adhesive such as ethylene vinyl acetate before being wrapped on the projectile. It should be noted that it is not desirable for the wrapping material to adhere to the cover sheet 21 of the payload package 16. If an aluminum cover sheet is utilized and ethylene vinyl acetate is used as the adhesive material, no problem arises because ethylene vinyl acetate will not strongly adhere to the aluminum. However, given other combinations of adhesive and cover sheet material, it may be desirable to coat or otherwise treat the cover sheet 21 to prevent adhesion of the wrapping material.

To provide ease of assembly, the strip of wrapping material is wrapped continuously along adjacent projectiles 11 so that it additionally covers a central portion 34 of the mandrel 22 which separates each adjacent pair of projectiles 11. The wrapping material may be placed around the projectiles 11 at a rate of about 10 to 20 windings per linear inch.

Figure 1:
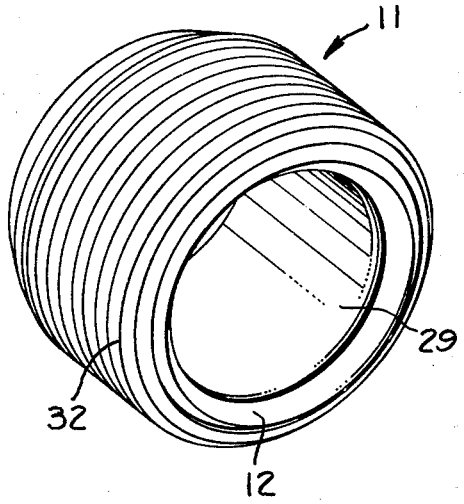
FIG. 1 is a perspective view of a payload-carrying tubular projectile in accordance with this invention.

After the projectiles on the mandrels have been wound, they are preferably placed in a suitable environment for drying the adhesive. During this procedure, the projectiles are preferably left on the mandrel so that any shrinking or other distortion of the dimensions of the projectile may be prevented. To remove the dried projectiles from the mandrels, the wrapping material is slit circumferentially a short distance in front of and behind the central portion 34 of each mandrel. This permits the assembly to be taken apart freeing each projectile which now has an appearance substantially as shown in FIG. 1.

The cross section of the completed projectile 11 is best illustrated in FIG. 4. The payload material 20 is held in the compartments 19 in the base 17 of the payload package 16. Each compartment 19 is cemented in its corresponding pocket 14 of the body 12. The base 17 is covered by the cover sheet 21 which is heat sealed or otherwise held in place. The strip of wrapping material 32 is wound around a projectile 11 to help hold the payload material 20 in place and to enhance the structural integrity of the projectile 11 while in flight.

As has been indicated, the wrapping material 32 adheres to itself and to the body 12 but does not strongly adhere to the cover sheet 21 of the payload package 16. To make it easier for the portion of the wrapping material 32 covering the payload package 16 to be stripped from the projectile 11 on impact, a circumferential slit 35 is preferably provided in the wrapping material 32 rearwardly of the payload package 16.

Figure 8:
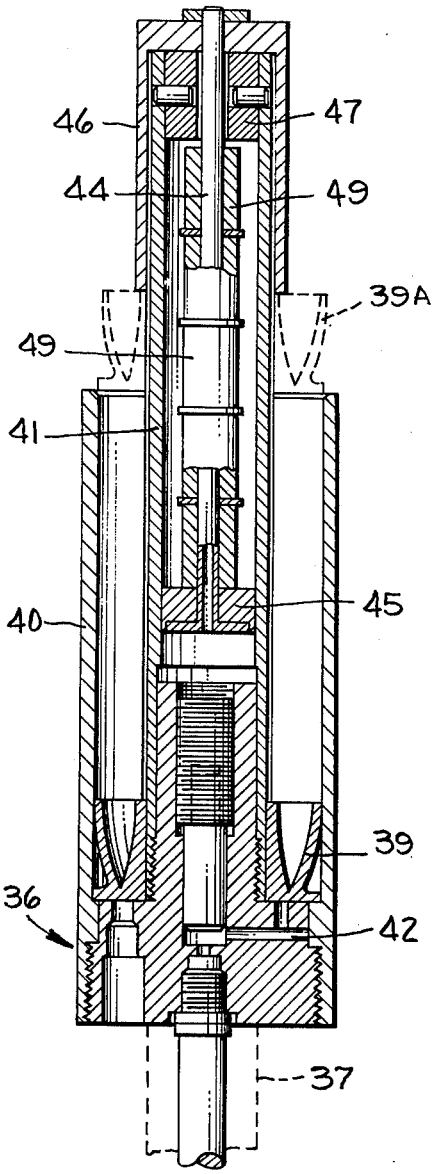
FIG. 8 is a cross-sectional view of a launcher for propelling the projectile of this invention.

The projectile 11 may be fired from a suitable launching device such as the launcher 36 illustrated in FIG. 8. The launcher 36 is attached to the end of a barrel 37 of a suitable gun. A captive piston 39 is provided with a suitable shape for holding the tubular projectile 11 and is held between an outer launching cylinder 40 and an inner launching cylinder 41. The inner launching cylinder is preferably rifled to provide a suitable twist, through the captive piston 39, to the projectile. A series of channels 42 facilitate the passage of gas pressure from the barrel 37 to a point rearward of the captive piston 39 when a cartridge is fired in the gun.

Within the inner launching cylinder 41 is an elongated piston rod 44 which connects a piston 45 to an energy transfer cylinder 46. Between the piston 45 and an end plug 47 which is pinned to the inner launching cylinder 41 are a plurality of energy absorbing cylinders 49.

A projectile to be fired is placed within the captive piston 39. Upon firing, gas pressure passing through the channels 42 forwardly propels the captive piston 39 which is caused to rotate by the rifling on the inner launching cylinder 41. The captive piston 39 and its contained projectile continue to accelerate until, upon reaching the position shown as 39A, gas leaks from behind the piston and the pressure decreases. At this point, the projectile has reached its maximum velocity and the captive piston 39 impacts against the energy transfer cylinder 46 which is moved forward carrying with it the piston rod 44 and piston 45. The piston 45 compresses the energy absorbing cylinders 49 stopping the forward motion of the captive piston 39 and releasing the projectile. The compression of the cylinders then applies a rearward force returning the captive piston 39 to its rest position.

Upon release from the launcher 36, the projectile 11 is propelled toward a target, preferably with a velocity of about 200 feet per second and a rate of rotation of about 5000 rpm. The ring airfoil shape produces great stability and permits the projectile to travel toward the target with a substantially flat trajectory. The relatively low velocity permits impact with the target, even at close range, with nonlethal force. The wrapping material 32 maintains the aerodynamic shape of the projectile during its flight. Although the wrapping material 32 must readily break upon impact, it must be supple and exhibit a limited elongation, generally on the order of about 1–2%, so that it remains intact in the launcher and, during flight, firmly holds the body 12 to prevent distortion from its aerodynamic configuration.

Figure 7:
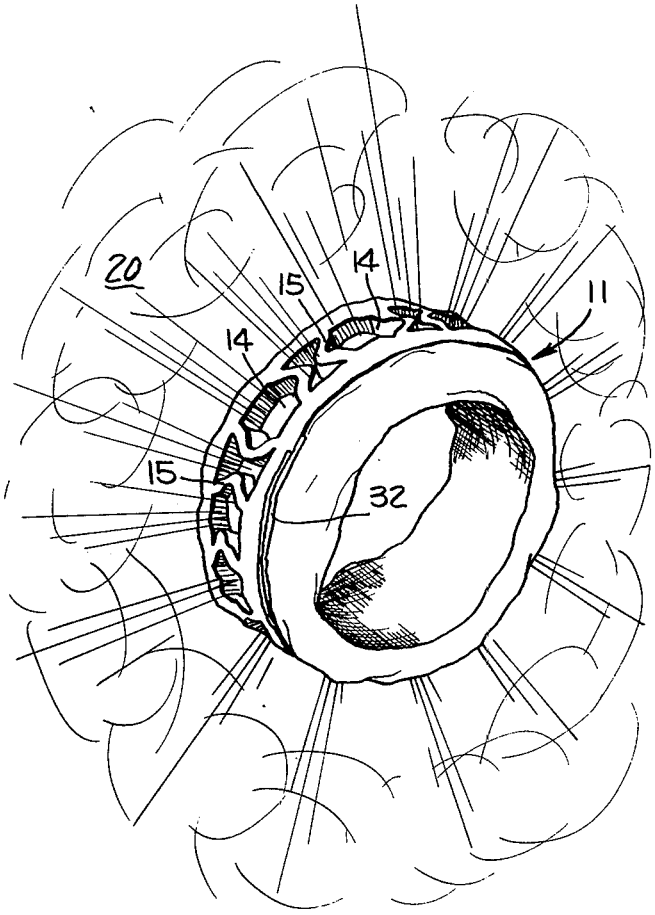
FIG. 7 is a perspective view illustrating payload dispersal upon impact of the projectile of this invention.

Upon impact, the projectile 11 collapses as is best shown in FIG. 7, each of the ribs 15 tending to fold on impact and force the payload material 20 from the pockets 14. When the projectile 11 collapses, that portion of the wrapping material 32 which surrounds the payload package within the pockets 14 breaks up and, inasmuch as it does not stick to the payload package, is removed from the projectile. If any of the wrapping material sticks to the cover sheet, it pulls portions of the cover sheet away as it leaves the projectile. The payload material is forced through the cover sheet producing substantial openings therein and is dispersed in a cloud in substantially all directions around the projectile. It will be readily apparent that highly effective dispersal of chemically irritant or dye marking materials can be accomplished by the use of this projectile without producing serious physical injury so that it may be utilized as an aid to the control of riots without risking serious injury to participants.

Figure 6:
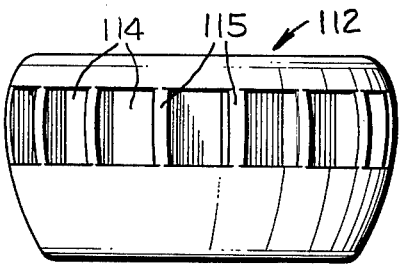
FIG. 6 is a side view of an alternate embodiment of the projectile body of this invention.

While the projectile may have a body such as the body 12 shown in FIG. 5 having a substantially cylindrical contour at the location of the pockets 14 and ribs 15, in an alternate embodiment, shown as body 112 in FIG. 6, the body does not deviate from the airfoil contour and maintains it through the portion wherein pockets 114 and ribs 115 are located.

I claim:

1. A projectile comprising a generally cylindrical body, a plurality of recessed pockets circumferentially extending around the outer peripheral surface of said body, circumferentially-spaced rib means separating adjacent pairs of said pockets, payload material positioned in said pockets, and wrapping means engaged around the body for holding said payload material in said pockets and breaking on impact to release said material.

2. A projectile as in claim 1 wherein said body is annular.

3. A projectile as in claim 2 wherein said body is molded of elastomeric material.

4. A projectile as in claim 1 wherein said payload material is held in a package having a plurality of compartments and the package is wrapped circumferentially around said body with a compartment in each of said pockets.

5. A projectile comprising an annular, generally cylindrical molded elastomeric body, a plurality of recessed pockets circumferentially extending around the outer peripheral surface of said body, circumferentially-spaced rib means separating adjacent pairs of said pockets, a payload package containing payload material in a plurality of compartments wrapped circumferentially around said body with a compartment in each of said pockets, and wrapping means engaged around said payload package and said body, breakable on impact, to release said payload material.

6. A method of making a projectile having a body, a payload, and wrapping material, said method comprising the steps of forming a generally cylindrical body with a plurality of recessed pockets circumferentially extending around the outer peripheral surface of said body and circumferentially-spaced rib means separating adjacent pairs of pockets, positioning payload material in the pockets of the body, and engaging wrapping material around the body and the payload for holding the payload material in the pockets and breaking on impact to release the payload material.

7. A method as in claim 6, in which the step of positioning payload material in the pockets of the body is carried out by forming a payload package having a plurality of compartments, and wrapping the package circumferentially around the body to position the compartments in the pockets of the body.

8. A method as in claim 7 wherein said payload is constructed from a base, a cover sheet and payload material by the steps of forming compartments in a base, filling the compartments with payload material, and covering the base with a cover sheet to enclose the compartments.

9. A method as in claim 7 including the additional step of circumferentially slitting said wrapping material behind said payload.

* * * * *